US009705185B2

(12) United States Patent
Hall et al.

(10) Patent No.: US 9,705,185 B2
(45) Date of Patent: Jul. 11, 2017

(54) INTEGRATED ANTENNA AND ANTENNA COMPONENT

(71) Applicant: Raytheon Company, Waltham, MA (US)

(72) Inventors: Charles A. Hall, Waltham, MA (US); Lawrence Paul Drury, III, Waltham, MA (US); Keith E. Sloffer, Waltham, MA (US)

(73) Assignee: Raytheon Company, Waltham, MA (US)

( * ) Notice: Subject to any disclaimer, the term of this patent is extended or adjusted under 35 U.S.C. 154(b) by 166 days.

(21) Appl. No.: 13/861,151

(22) Filed: Apr. 11, 2013

(65) Prior Publication Data

US 2014/0306851 A1 Oct. 16, 2014

(51) Int. Cl.

*H01Q 1/28* (2006.01)
*H01Q 13/02* (2006.01)
*H01Q 13/08* (2006.01)

(52) U.S. Cl.

CPC ..... *H01Q 1/28* (2013.01); *H01Q 13/0275* (2013.01); *H01Q 13/085* (2013.01)

(58) Field of Classification Search

CPC ..... H01Q 1/28
USPC ..... 343/705, 700 MS, 708, 755; 244/199.4; 342/25 F

See application file for complete search history.

(56) References Cited

U.S. PATENT DOCUMENTS 2,425,303 A 8/1947 Carter
3,656,164 A * 4/1972 Rempt ..... 343/705
3,693,913 A * 9/1972 Barland et al. ..... 244/130
4,635,066 A 1/1987 St. Clair et al.
5,428,530 A * 6/1995 Brown ..... F41G 3/26 342/13
5,825,332 A 10/1998 Camacho et al.
6,094,171 A 7/2000 Riddle et al.
6,198,445 B1 3/2001 Alt et al.
6,414,645 B1 7/2002 Dahlberg
6,496,151 B1 * 12/2002 Ferreri et al. ..... 343/708
6,653,980 B2 * 11/2003 Ceccom et al. ..... 343/705
7,624,951 B1 * 12/2009 Kraft ..... B64C 1/36 244/1 R
7,649,501 B2 1/2010 Wong et al.
7,889,142 B1 * 2/2011 Westman ..... 343/705
8,773,319 B1 * 7/2014 Anderson et al. ..... 343/755
2004/0257441 A1 * 12/2004 Pevear ..... B64D 47/08 348/144
2005/0122274 A1 * 6/2005 Marsan ..... H01Q 1/28 343/773
2005/0156786 A1 * 7/2005 Blaschke et al. ..... 343/700 MS
(Continued)

OTHER PUBLICATIONS

PCT application PCT/US2014/033853; filing date Apr. 11, 2014; Raytheon Company; International Search Report mailed Jan. 15, 2015.

*Primary Examiner* — Huedung Mancuso

(57) ABSTRACT

An antenna is disclosed. The antenna can include an aerodynamic surface and an antenna component comprising a structure configured to extend from the aerodynamic surface. The structure and at least a portion of the aerodynamic surface can form an antenna, such as a half double-ridge horn antenna or a half Vivaldi antenna. In one aspect, the structure can be configured to support a pod, thus integrating the antenna with a mechanical mounting structure for the pod.

20 Claims, 4 Drawing Sheets

(56) References Cited

U.S. PATENT DOCUMENTS

| | | | | |
|---|---|---|---|---|
| 2007/0252748 | A1 | 11/2007 | Rees et al. | |
| 2008/0115199 | A1* | 5/2008 | Young et al. | 726/6 |
| 2009/0100995 | A1* | 4/2009 | Fisher | B64D 1/04 89/1.11 |
| 2009/0102705 | A1* | 4/2009 | Obermeyer | 342/25 F |
| 2010/0326246 | A1* | 12/2010 | Chang | B25B 13/04 81/60 |
| 2011/0264314 | A1* | 10/2011 | Parras | G05D 1/0676 701/16 |
| 2012/0171981 | A1* | 7/2012 | Hiers | H01Q 13/0275 455/334 |
| 2012/0291996 | A1* | 11/2012 | Nilsson et al. | 165/104.11 |
| 2013/0038495 | A1 | 2/2013 | Benzel et al. | |
| 2014/0070054 | A1* | 3/2014 | Burton et al. | 244/134 D |
| 2015/0298807 | A1* | 10/2015 | Chun | B64C 7/00 244/137.4 |

* cited by examiner

INTEGRATED ANTENNA AND ANTENNA COMPONENT

BACKGROUND

Small unmanned aerial vehicles (UAVs) have limited payload lift and primary power capacities. In order for communications and communications countermeasures to be successfully implemented on small UAVs, it can be important to utilize the lift and power capacity of the aircraft to achieve the necessary radio frequency (RF) energy on the ground while not overloading the aircraft power and lift capability, and while flying within the specified aircraft altitude envelope.

Some antennas for aircraft have been embedded within non-conductive wing structures. Other such antennas utilize slots, notches, and horn structures within conductive structures. For example, a notch antenna has been used within a tail rudder section of a large aircraft for high frequency (HF) communications and antenna elements have been surface mounted within wing sections of aircraft.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Reference will now be made to the exemplary embodiments illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

An initial overview of technology embodiments is provided below and then specific technology embodiments are described in further detail later. This initial summary is intended to aid readers in understanding the technology more quickly but is not intended to identify key features or essential features of the technology nor is it intended to limit the scope of the claimed subject matter.

Although typical antennas have proven functional for many aircraft applications, small UAVs can limit the size and/or weight available for antennas in order to meet mission objectives.

Accordingly, and generally speaking, an antenna is disclosed that reduces the size and/or weight over typical antennas used for aircraft. In one embodiment, antenna features as well as structural support features for an equipment pod are integrated or combined. The antenna can include an aerodynamic surface and a structure extending from the aerodynamic surface. The structure and at least a portion of the aerodynamic surface can form an antenna.

In another embodiment, an antenna component is disclosed. The antenna component can include a structure configured to extend from an aerodynamic surface. The structure and at least a portion of the aerodynamic surface can form an antenna.

Figure 1:
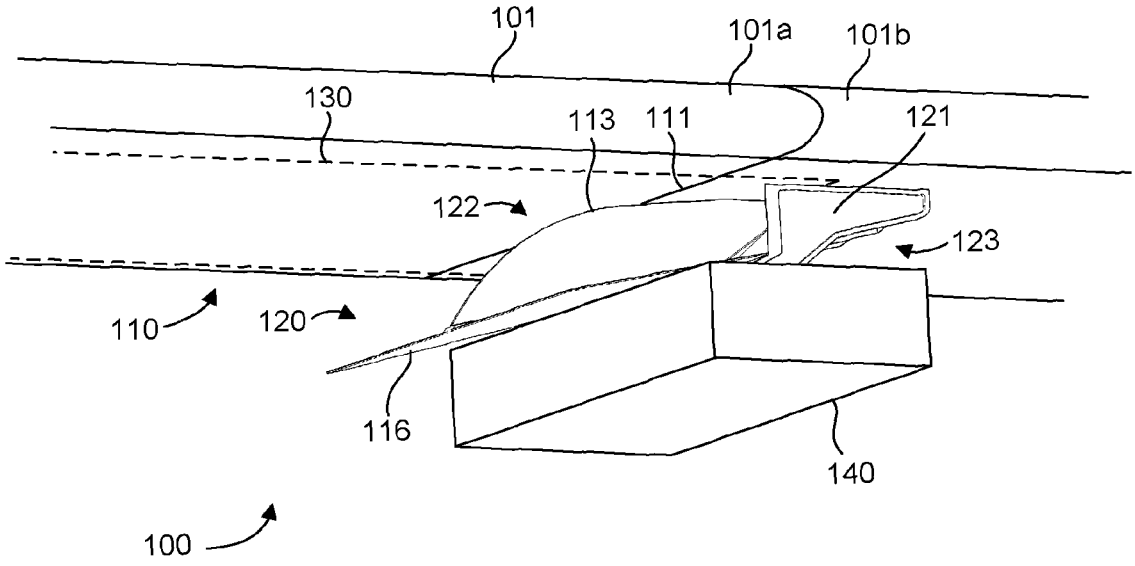
FIG. 1 is an example illustration of an antenna in accordance with an embodiment of the present invention.

One exemplary embodiment of an antenna 100 is illustrated in FIG. 1. The antenna 100 can include or incorporate or integrate as part of its structure an aerodynamic surface 110, such as an air foil. The aerodynamic surface 110 can be part of a wing 101 of an aircraft, such as a UAV. It should be recognized that the aerodynamic surface 110 can be any such surface of an aircraft, such as an exterior aerodynamic surface of an aircraft hull or fuselage.

Figure 2A:
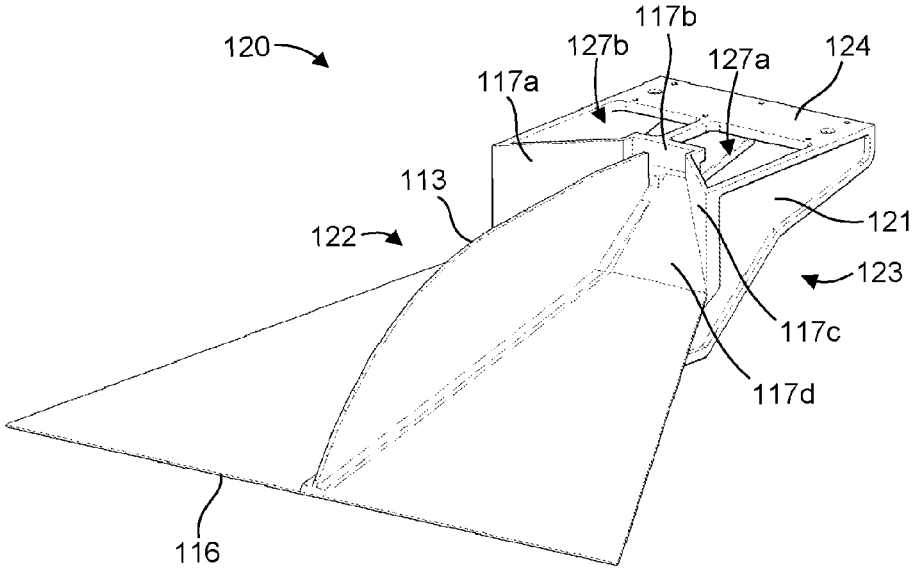
FIGS. 2A and 2B are perspective views of a component of the antenna of FIG. 1.
Figure 2B:
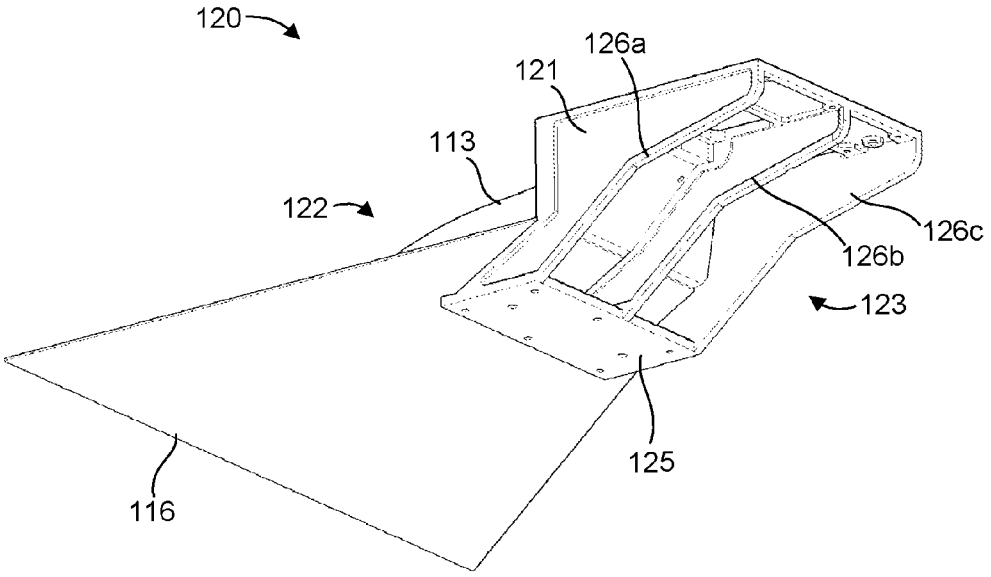

With reference to FIGS. 2A and 2B, and continued reference to FIG. 1, the antenna 100 can also include antenna component 120, comprising a structure 121 extending from the aerodynamic surface 110. In one aspect, the structure 121 can be cantilevered from the aerodynamic surface 110, such as by coupling to a support member (hidden from view) for the aerodynamic surface 110. The structure 121 and at least a portion of the aerodynamic surface 110, which can have electrically conductive and/or reflective characteristics, can form the antenna 100. The antenna component 120 can be oriented in any suitable relationship to the aerodynamic surface and/or a direction of travel of the aircraft.

In one aspect, the antenna 100 can be configured as a "half horn" antenna, such as a half double-ridge horn antenna or a half Vivaldi antenna. In particular, an electrically conductive and/or reflective aerodynamic surface 110 and the antenna component extending from the aerodynamic surface 110 can be configured to form a half double-ridge horn antenna or a half Vivaldi antenna. Utilizing the electrically conductive and/or reflective characteristics of the aerodynamic surface 110, a "full horn" antenna structure can be effectively cut in half providing an antenna portion 122 of the antenna component 120. The conductive aerodynamic surface 110 can form the complementary portion, or "other half" of the half horn antenna 100, which can result in a weight savings over a full horn antenna. In one aspect, the antenna 100 can be a broadband RF antenna. The antenna portion 122 can comprise any suitable structure or feature, such as a ridge 113 and a flared plate 116, as well as surfaces 117*a*, 117*b*, 117*c*, 117*d* that can form a base of a horn or Vivaldi antenna. The plate 116 can comprise an upper surface that faces in an opposing direction with respect to the portion of the aerodynamic surface to be incorporated or integrated into the antenna 100.

Figure 3A:
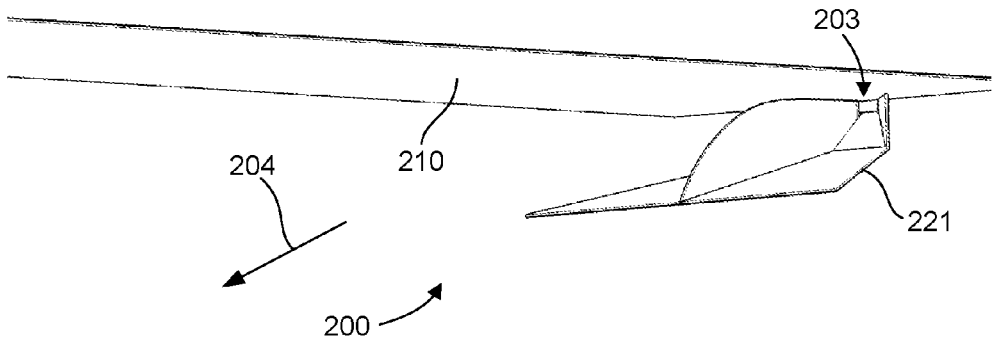
FIG. 3A is a perspective view of an antenna component in accordance with an embodiment of the present invention.

As shown in FIG. 3A, an antenna 200 in accordance with another example of the present disclosure is configured as a "half horn" antenna. In particular, an electrically conductive and/or reflective aerodynamic surface 210 and a structure 221 extending from the aerodynamic surface 210 can be configured to form a half double-ridge horn antenna or a half Vivaldi antenna. Utilizing the electrically conductive and/or reflective characteristics of the aerodynamic surface 210, a "full horn" antenna structure can be effectively cut in half providing the structure 221. The conductive aerodynamic surface 210 can form the complementary portion, or "other half" of the half horn antenna 200. The feed point 203 can be proximate the aerodynamic surface 210. Utilizing the reflective characteristic of the aerodynamic surface 210 and the location of the feed point 203 can increase the gain of the antenna 200 in a direction 204. For example, the gain in direction 204 can be increased by 3-6 dB over a full horn antenna. When the antenna 200 is formed on an underside of a wing of a UAV, for example, this can increase electromagnetic radiation gain in a lower quadrant relative to the UAV on the ground, where projected energy can be most beneficial. This can reduce the primary power that the aircraft must supply when compared to an antenna that does not make use of the underside of the aircraft wing with its reflective characteristics. An antenna of the present disclosure can therefore utilize the reflection from the underside of a wing to advantage, as opposed to the reflection causing undesirable scatter and/or out of phase cancellation as can occur with other antennas located on or about the wing that do not integrate the wing as part of the antenna.

Figure 3B:
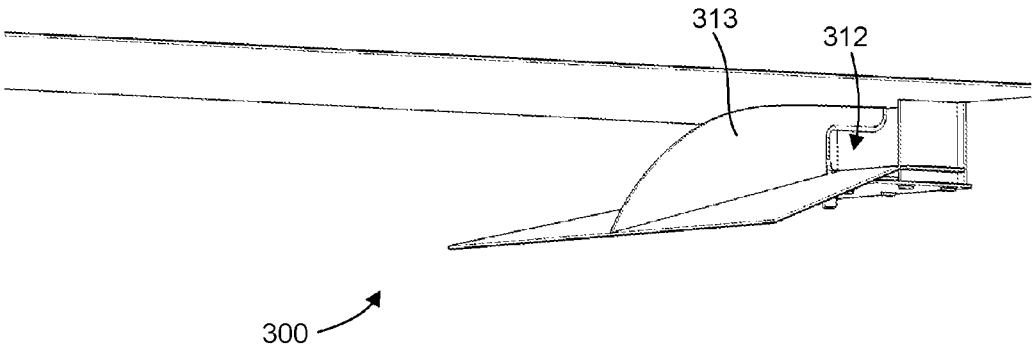
FIG. 3B is a perspective view of an antenna component in accordance with another embodiment of the present invention.

FIG. 3B illustrates another antenna 300 in accordance with the present disclosure. The antenna 300 can include an opening 312 in a base or rear portion of a ridge 313 of the antenna 300. The opening 312 in the ridge 313 can improve lower frequency response over an antenna having a typical ridge structure, such as in the antenna 200 of FIG. 3A. The size and/or shape of the opening 312 can be configured as needed.

Referring again to FIGS. 1-2B, the antenna 100 can include a conductive cladding 130 configured to cover a portion of the aerodynamic surface 110, and at least a portion of the aerodynamic surface 110 to be integrated as part of the antenna 100. The conductive cladding 130 can be utilized to enhance RF performance of the aerodynamic surface 110. For example, the conductive cladding 130 can cover a discontinuity 111 in the aerodynamic surface 110, such as a discontinuity formed by adjoining sections 101*a*, 101*b* of the wing 101. In another example, the conductive cladding 130 can provide a conductive and/or reflective surface for an aerodynamic surface that lacks these attributes. In one aspect, the conductive cladding 130 can comprise copper tape or any other suitable conductive and/or reflective tape, foil, or other cladding.

In one aspect, the structure 121 can be configured to support a pod 140. The pod 140 can be used to house equipment or components of an aircraft or serve as a storage compartment. For example, the pod 140 can house electronic components for an aircraft, such as communications electronics, communications countermeasures electronics, power amplifiers, batteries, sensors, etc. Accordingly, the structure 121 can have an antenna portion 122 that provides an antenna function, as described hereinabove, and a support portion 123 to provide structural support for the pod 140 in order to couple the pod 140 to an aircraft, such as to an underside of the wing 101, as shown in FIG. 1. In one aspect, therefore, the antenna 100 can be said to comprise features and structures that provide structural attributes for supporting the pod 140 as well as features and structures that provide antenna function, all in a single device. For example, the antenna portion 122 of the structure 121 can be integrated with the support portion 123 of the structure 121 such that the structure 121 can provide an antenna function and a structural mount for the pod 140. In the particular embodiment illustrated, the antenna 100 can incorporate half of a double ridge horn into the mounting structure for the pod 140 while using the underside of the conductive and/or reflective aerodynamic surface of the wing to virtually form, through electromagnetic reflection, "the other half" of a double ridge horn antenna. Thus, in one aspect, a shape of structure 121 can form half of an open frame double ridge horn antenna. Accordingly, it should be recognized that the ridge 113, the flared plate 116, surfaces 117*a*, 117*b*, 117*c*, 117*d*, or any such structure or feature of an antenna can be integrated into the support portion 123 of the structure 121.

In other words, the antenna 100 of the present disclosure can have dual use or functionality in an electromagnetic structure that provides both mechanical and electrical functions by incorporating half of a horn antenna into the support structure 121 for the pod 140. For example, the mechanical functionality can include attachment to the aircraft and supporting the pod via support portion 123, while the electrical function of RF radiation is achieved via radiation from the formed electromechanical structure of the antenna portion 122. Utilizing the pod support structure 121 as part of the antenna 100 can reduce weight over a typical antenna structure, thereby conserving the lift capacity that would otherwise need to be allocated to the antenna structure, either attached to or within the pod 140 or attached elsewhere on the aircraft. This can reduce the needed lift capacity of the aircraft and/or can allow additional weight capacity that can permit additional electrical components to be housed within the pod 140 or mounted to the aircraft. The dual use of the support structure 121 as part of a radiating antenna can also reduce system cost.

In one aspect, the antenna 100 can provide full band antenna coverage for pod-mounted UAV communications and/or communications countermeasures systems that can be readily installed and/or removed from the UAV with only minor aircraft modifications. The support portion 123 of the structure 121 can include an aircraft coupling interface 124 for mounting the structure 121 to the wing 101, for example. In addition, the support portion 123 of the structure 121 can include a pod coupling interface 125 for mounting the pod 140 to the structure 121. The support portion 123 of the structure 121 can also include one or more struts 126*a*, 126*b*, 126*c* to provide mechanical structural support for the antenna portion 122 as well as the pod 140. The struts 126*a*, 126*b*, 126*c*, as well as the coupling interfaces 124, 125 can be configured to provide the necessary support while also minimizing weight. Weight savings can also be achieved by incorporating openings 127*a*, 127*b* in the structure 121. The openings 127*a*, 127*b* can be configured to provide sufficient material for the coupling interface 124, struts 126*a*, 126*b*, 126*c*, and maintain the functional antenna structure of antenna portion 122 while also eliminating unnecessary weight. In one aspect, the openings 127*a*, 127*b* can provide access or a passageway for electronic connection (e.g., wires or cables) from the wing to the antenna portion 122 and/or to the pod 140. For example, the center strut 126*b* can be located "off-center" or closer to strut 126*c*, as shown, in order to accommodate such an electrical connection.

Figure 4A:
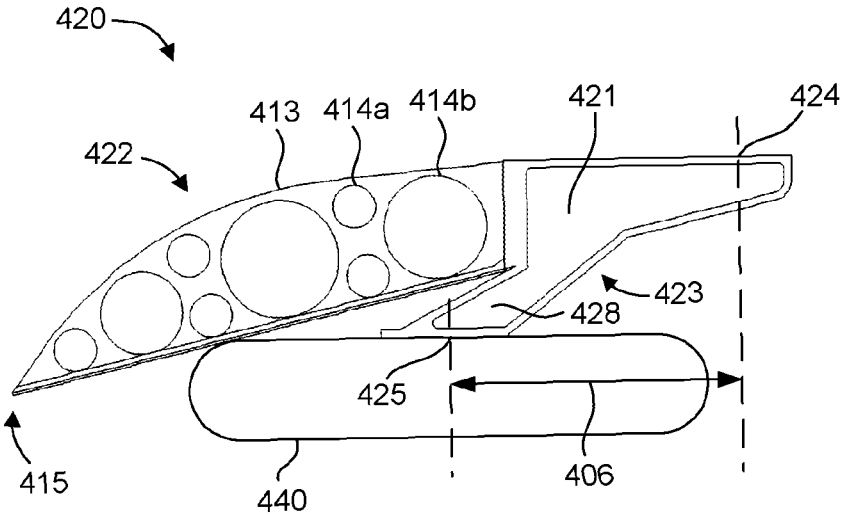
FIG. 4A is a side view of an antenna component in accordance with yet another embodiment of the present invention.
Figure 4B:
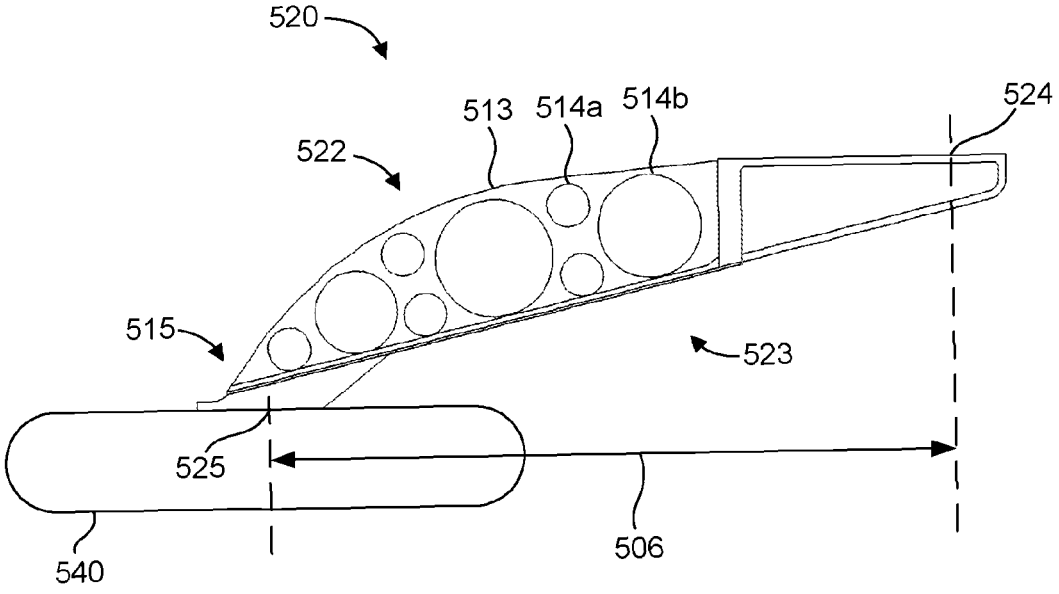
FIG. 4B is a side view of an antenna component in accordance with still another embodiment of the present invention.

FIGS. 4A and 4B illustrate additional example embodiments of antenna components in accordance with the present disclosure. For example, antenna component 420 includes a ridge 413 having one or more features, such as openings or holes 414*a*, 414*b* to reduce aerodynamic drag on the ridge 413 by facilitating airflow through the ridge 413 when the ridge 413 is oriented substantially perpendicular to a direction of travel, such as into the page of FIG. 4A. In one aspect, the openings or holes 414*a*, 414*b* can also reduce the weight of the ridge 413 and antenna component 420. Similar to the antenna component 120 of FIGS. 1-2B, the antenna component 420 can have a support portion 423 of a structure 421 that is configured to support and locate a pod 440, such that an end 415 of the antenna portion 422 extends beyond the pod 440. In addition, an extension 428 of the support portion 423 can be employed, which can be separate from the structure of the antenna portion 422. This configuration, and the extension 428, can be utilized when a desired offset 406 between coupling interfaces 424, 425 is insufficient to locate the pod 440 beyond the antenna portion 422. An offset 406 can be dictated by space constraints below a wing, for example, such as making room for a weapon system, fuel tank, sensor array, launching structure/mechanism, etc.

Like the antenna component 420 of FIG. 4A, the antenna component 520 of FIG. 4B is shown with a ridge 513 with openings or holes 514*a*, 514*b* to reduce aerodynamic drag on the ridge 513. However, the antenna component 520 includes a support portion 523 that is configured to locate a pod 540 beyond an end 515 of an antenna portion 522. This configuration can be utilized to accommodate an offset 506 between coupling interfaces 524, 525 that is relatively large. This configuration also illustrates a more extensive integration of antenna portion 522 and support portion 523 structures, as the pod 550 is effectively mounted at the end 515 of the antenna portion 522. The support portion 523 can therefore be configured to provide structural support along the antenna portion 522 sufficient to support the antenna portion 522 and the pod 540.

In accordance with one embodiment of the present invention, a method for facilitating construction of an antenna is disclosed. The method can comprise providing a structure configured to extend from an aerodynamic surface. The method can further comprise facilitating use of the structure and at least a portion of the aerodynamic surface as an antenna. It is noted that no specific order is required in this method, though generally in one embodiment, these method steps can be carried out sequentially.

In one aspect of the method, the structure and the aerodynamic surface can be configured to form a half-double ridge horn antenna or a half Vivaldi antenna. In another aspect of the method, the aerodynamic surface can comprise a wing of an aircraft. In yet another aspect of the method, the structure can be configured to support a pod.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. An antenna component, comprising:

an antenna structure forming part of an antenna, the antenna structure being configured to extend from a surface of an aerodynamic structure into a region of airflow about the surface, wherein the antenna structure and at least a conductive portion of the surface operate together to form the antenna having a feed point at the surface; and a support portion having a storage pod coupling interface to couple with and provide structural support for a storage pod.

2. The antenna component of claim 1, wherein the antenna structure and the surface are configured to form a half double-ridge horn antenna or a half Vivaldi antenna.

3. The antenna component of claim 1, wherein the antenna structure and the support portion are integrated with one another.

4. The antenna component of claim 1, wherein the antenna structure is configured to be cantilevered from a support member for the surface.

5. The antenna component of claim 1, wherein the surface comprises a portion of a wing of an aircraft and the support portion comprises an aircraft coupling interface for mounting the antenna component to the wing.

6. An antenna, comprising:

a portion of a surface of an aerodynamic structure, the portion of the surface forming part of an antenna;

an antenna structure forming part of the antenna, the antenna structure extending from the portion of the surface into a region of airflow about the surface, wherein the antenna structure and a conductive portion of the surface operate together to form the antenna having a feed point at the surface.

7. The antenna of claim 6, wherein the antenna structure and the surface are configured to form a half double-ridge horn antenna or a half Vivaldi antenna.

8. The antenna of claim 6, wherein the surface forms part of an aircraft.

9. The antenna of claim 6, wherein the aerodynamic structure comprises an air foil.

10. The antenna of claim 9, wherein the air foil comprises a wing.

11. The antenna of claim 6, wherein the antenna structure and the support portion are integrated with one another.

12. The antenna of claim 6, wherein the antenna structure is cantilevered from a support member for the surface.

13. The antenna of claim 6, wherein the aerodynamic structure comprises a portion of a wing of an aircraft and the support portion comprises an aircraft coupling interface for mounting the antenna component to the wing.

14. The antenna of claim 6, further comprising a conductive cladding configured to cover a portion of the surface to enhance RF performance of the aerodynamic surface.

15. The antenna of claim 14, wherein the conductive cladding comprises copper tape.

16. The antenna of claim 14, wherein the conductive cladding covers a discontinuity in the aerodynamic surface.

17. A method for facilitating construction of an antenna, comprising:

providing an antenna structure defining part of an antenna, the antenna structure being configured to extend from a surface of an aerodynamic structure into a region of airflow about the surface, a conductive portion of the surface and the antenna structure operating together to form the antenna having a feed point at the surface;

providing a support portion having a storage pod coupling interface to couple with and provide structural support for a storage pod; and facilitating use of the antenna structure and at least a portion of the surface as an antenna.

18. The method of claim 17, wherein the antenna structure and the surface are configured to form a half-double ridge horn antenna or a half Vivaldi antenna.

19. The method of claim 17, wherein the surface comprises a portion of a wing of an aircraft and the support portion comprises an aircraft coupling interface for mounting the antenna component to the wing.

20. The method of claim 17, wherein the antenna structure and the support portion are integrated with one another.

* * * * *